US008048839B2

(12) United States Patent
Della Cuna et al.

(10) Patent No.: US 8,048,839 B2
(45) Date of Patent: Nov. 1, 2011

(54) HIGHLY ANTI-DEODORIZING AND AIDING AGENTS FOR WASHING CLOTHING ARTICLES

(76) Inventors: Maurizio Della Cuna, Lugo (IT); Laura Della Cuna, Lugo (IT)

( * ) Notice: Subject to any disclaimer, the term of this patent is extended or adjusted under 35 U.S.C. 154(b) by 0 days.

(21) Appl. No.: 12/012,599

(22) Filed: Feb. 4, 2008

(65) Prior Publication Data

US 2008/0196169 A1 Aug. 21, 2008

Related U.S. Application Data

(63) Continuation of application No. 10/734,433, filed on Dec. 12, 2003, now abandoned.

(30) Foreign Application Priority Data

Feb. 6, 2003 (IT) ..... MI2003A0202

(51) Int. Cl.
*C11D 3/20* (2006.01)

(52) U.S. Cl. ..... 510/319

(58) Field of Classification Search ..... 510/319
See application file for complete search history.

(56) References Cited

U.S. PATENT DOCUMENTS 4,056,355 A * 11/1977 Kolaian et al. ..... 8/137
4,304,689 A * 12/1981 Boden et al. ..... 512/25
5,702,635 A * 12/1997 Trani et al. ..... 252/186.27
5,880,076 A * 3/1999 Vermeer ..... 510/123

* cited by examiner

*Primary Examiner* — John Hardee
(74) *Attorney, Agent, or Firm* — Hedman & Costigan, P.C.; James V. Costigan

(57) ABSTRACT

A highly anti-deodorizing cleansing and aiding agent for washing clothing articles, wherein the aiding agent comprises active principles including alpha and beta hydroxy acid and aliphatic alcohol esters having anti-deodorizing properties.

4 Claims, No Drawings

HIGHLY ANTI-DEODORIZING AND AIDING AGENTS FOR WASHING CLOTHING ARTICLES

This application is a continuation of Ser. No. 10/734,433, filed Dec. 12, 2003 now abandoned.

BACKGROUND OF THE INVENTION

The present invention relates to highly anti-deodorizing cleansing and aiding agents for washing clothing articles.

More specifically, the invention relates to the provision of washing cleansing and aiding agents which, after rinsing the cloth or clothing articles, allow a comparatively high amount or rate of their active substances to remain bound to the fiber material of the clothing articles, to be worn, obviously in a dried and optionally ironed condition thereof, by a user, in particular a user performing physical exercises.

Actually, as the above mentioned active substances, contact a user skin, they prevent perspiration from generating bad smells or odors, while allowing to "cover" and eliminate smoke, kitchen and domestic pet bad odors.

The invention, in particular, provides cleansing and/or aiding agents which can be made starting from active substances which can comprise short chain alpha and beta hydroxy acids and isomeric aliphatic alcohols, which are added to prevent generation of bad odors originated by human perspiration.

For aiding the efficiency of the above esters, the following other active principles and components are added: essential oils and aliphatic alcohols such as linear or branched chain undecanol, bacteriostatic and/or bactericide surface active agents, including, for example, zinc and magnesium derivative compounds, such as Zinc Coceth Sulphates, also commercially known as Zetesol Les 3Zn, zinc ricinoleate, acylglutammate from C8-C10 fat acids, commercially called Protelan AG8, and other surface active agents obtained from octyl acid and glycerin of a Sensiva SC50 type, trichloro hydroxy diphenyl ethers and dichloro hydroxy diphenyl ethers.

The above mentioned cleansing and/or aiding agents can also include smell masking or covering agents, such as fragrances, for masking or covering body bad smells, fragrances preventing an enzymatic degeneration and adapted to mask smoke and kitchens odors, and domestic animal bad odors.

In addition to the above mentioned cleansing and/or aiding agents, it is also possible to use odorous molecule inorganic sequestering agents, such as complex silicates, in particular active bentonites and zeolites.

In addition, it is also possible to add odorous molecule organic sequestering substances, such as cyclodextrins.

To provide optimum effects of said cleansing and/or aiding agents, it is also possible to include antioxidating materials, such as tocopherol and propylgallate, and anti-perspiring substances, such as ammonium salts.

The above mentioned substances provide cleansing and aiding agents adapted to provide processed articles of clothing with improved properties since, upon washing, their fabric material would acquire a lot of different useful properties, directly deriving from the active substances or principles held therein.

For better understanding the exploited mechanism, it would be useful to briefly disclose the human perspiration controlling mechanism.

Actually, as is known, a main cause of bad human body smells are gland secretions, in particular of perspiration and sebaceous glands.

Perspiration glands can be divided into eccrine glands, usually present in a comparatively high amount on the hand palms, foot backs, forehead and forearms, which however are devoid of any relationships with the pile-sebaceous apparatus, and have an apocryphal nature.

Said perspiration glands are essentially concentrated in the axillary, perianal and breast regions.

Their secretion activity is a continuous one, and is not controlled by the human nervous system.

The sebaceous glands pertain to the pile-sebaceous system, are open in the pile follicles, and their sebaceous activity is affected by hormonal factors.

The perspiration and sebaceous gland secretions, as they are produced, are devoid of any odors or smells.

A bad odor is formed in a later time, because of a bacteric attack against the microflora present on the skin.

The microbic flora involved in the above mentioned degradation process is mainly constituted by the saprophyte microflora, substantially comprising gram positive bacteria, aerobic and anaerobic bacteria, and, in a less degree, gram negative bacteria, yeast and mycetes.

The lipid enzymatic activity of saprophyte bacteria causes a decomposition of the gland secretions, to produce free fat acids, i.e. substances having a characteristic rancid and pungent smell, such as: butyric acid, caprinic acid and isovalerianic acid.

The proposed mechanism, which constitutes the subject matter of the present invention, provide that alpha and beta hydroxy acid ester molecules deposited on the cloth or fabric materials, and contacting the enzymes elaborated by the skin saprophyte microorganisms, are decomposed to aliphatic alcohols and odorless alpha hydroxy acids, thereby preventing enzymes from degrading perspiration, and generating the above mentioned short chain fat acids, which are responsible of the body bad smell.

Owing to the above mentioned mechanism, clothing articles, pre-washed by the above mentioned washing cleansing and aiding agents, formulated as above disclosed, are preserved in an odorless or slightly odorous condition, even after an intensive sports activity.

To improve the efficiency of the above mentioned esters, it is possible to further include therein bacteriostatic and/or bactericide surface active substances, such as ethers obtained from octyl acid and glycerin, and having smell masking properties, fat substances including body smell masking fragrances, and fragrances adapted to prevent any enzymatic degeneration and mask or cover smoke and kitchen smells or domestic animal smells, odorous molecule inorganic sequestering substances, odorous molecule organic sequestering substances, anti-oxidating, anti-perspiring substances, such as ammonium salts, essential oils and aliphatic alcohols, in particular linear or branched chain undecanol.

The latter have synergic properties against a perspiration microbic degeneration.

Clothing articles to be processed by the above mentioned cleansing and aiding agents can comprise natural proteic (proteinaceous) fibers (silk, wool fibers), natural polysaccharide fibers (cotton, flax fibers) and synthetic fibers (nylon, rayon, polyester, polyamide fibers) and any suitable combinations thereof.

The invention also provides to add the above mentioned specific active principles or substances, adapted to provide the above disclosed functions, to washing bases or washing and ironing aiding agents or substances.

In particular, the above mentioned active principles can be added to softening, stain removing agents, and sizing and whitening substances.

The latter products can be constituted by liquids, gels, powders, tablets and single-dose packets.

The active principles according to the present invention comprise one or more esters defined by the following formula:

R—O—R' where R is an alkyl radical, either of a linear or branched configuration, with a C2-C34 chain and R' being an alpha or beta hydroxy acid radical derived, for example, from glycolic, lactic, cictric, malic, tartaric, glugonic or mandelic acids.

By way of an example, the following esters can be mentioned:

glycol ester glycol ester

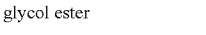

R = $C_2$-$C_{34}$ lactic ester

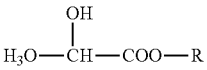

R = $C_2$-$C_{34}$ citric ester

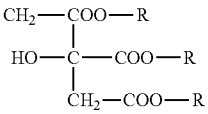

R = $C_2$-$C_{34}$ malic ester

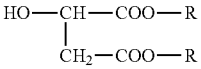

R = $C_2$-$C_{34}$ tartaric ester

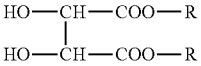

R = $C_2$-$C_{34}$ gluconic ester

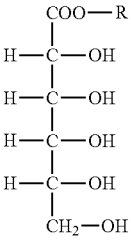

R = $C_2$-$C_{34}$ mandelic ester

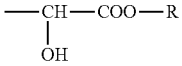

R = $C_2$-$C_{34}$

The above active principles can be added to the washing bases or aiding bases, in a weight rate from 0.1 to 10%.

Other active principles or substances which can be also added comprise bacteriostatic and/or bactericide surface active agents, surface active substances such as ethers obtained from octyl acid and glycerin, smell masking substances, i.e. fragrances for covering body smells, fragrances preventing any enzymatic degeneration and fragrances for covering smoke or kitchen smells and domestic animal smells, odorous molecule inorganic sequestering substances, odorous molecule organic sequestering substances, anti-oxidating and anti-perspiring substances, such as ammonium salts, short chain isomeric aliphatic alcohols, for example: aliphatic alcohol, linear or branched chain undecanol.

The above mentioned active principles can be added to the washing or aiding bases in a weight rate from 0.1% to 10%.

Optimum results have been practically obtained by adding the above active principles, in the above mentioned weight rates, to a series of washing bases, as those disclosed in the following indicative Examples.

Washing Base No. 1

This is a washing base comprising liquid, gel, suspension powder substances, single-dose packets containing one or more of the following materials:

- anionic bases (sodium, tea, ammonium laurylether sulphate, zinc laurylether sulphate; sodium, tea, ammonium lauryl sulphate; sodium, tea, ammonium alkylbenzenesulphonate; sodium, tea, ammonium alkanesulphonates; sodium, tea, ammonium sulphonated alpha-olefins), by a weight rate dose from 0.1 to 50%;
- non ionic bases (ethoxylated alcohols having a linear or branched C3-C22 alkyl chain and an ethoxylation and propoxylation degree from 2 to 30 moles; fat acid amides; alkylpolyglucosides; amine oxides), with a dose, by a weight rate from 0.1 to 50%;
- amphoteric bases (alkylamidobetaine, alkylamidopropylbetaine, alkylamidosultaine), with a dose, by a weight rate from 0.1 to 50%;
- cationic bases (dialkylmethyl ammonium methasulphate; quaternized tert amines, imidazoline), with a dose, by a weight rate from 0.1 to 50%;
- soaps (fat acids salified by sodium, potassium, mea, tea), by a weight rate from 0.1 to 50%;
- coformulating and coactive agents: (phosphonates; ethylendiamine tetracetic acid derivatives; citric acid and sodium and potassium derivatives, ethylene, propylene, dipropylene glycols; ethyl and isopropyl alcohl; activated bentonites; calcium and sodium chlorides; amilolitic, lipolitic, proteolitic enzymes; polyvinyl pirrolidone and derivatives thereof; optic whitening agents derived from distirildiphenyl; polymeric styrene/acryl dispersions; polyacrylates; dymethylpolysiloxanes; isothiazolinones, benzoisothiazolinones, bronopol, N-formals; coloring agents), by a weight rate from 0.1 to 20%;
- natural essences or essence compositions, by a weight rate from 0.1 to 5%.

Washing Base No. 2

This washing base comprises powder substances, in a pressed form (tablets) and single-dose packets.

The formulation according to the present invention comprises one or more of the following substances:

- anionic bases (sodium, tea, ammonium alcansulphonates; sodium, tea, ammonium lauryl sulphate; sodium, tea, ammonium alkylbenzene sulphonate) by a weight rate of 0.1 to 30%
  1. non ionic bases (ethoxylated alcohols with a linear or branched C3-C22 alkyl chain and an ethoxylation and propoxylation degree from 2 to 20 moles; fat acid amides; alkylpolyglucosides; amine oxides), by a weight rate from 0.1 to 30%;
- amphoteric bases (alkylamidobetaines, alkylamidopropylbetaines, alkylamidosultaines), by a weight rate of 0.1 to 50%;
- soaps (sodium salified fat acids), by a weight rate of 0.1 to 30%;
- filling substances: (powder and grained sodium sulphate, dense and light sodium carbonate, sodium silicate and disilicate), by a weight rate of 0.1 to 40%;
- coformulating and coactive substances: (zeolites; mono and tetrahydrate sodium perborate, sodium percarbonate, sodium persulphate; phosphonates; ethylendiamine tetracetic acid derivatives; citric acid and sodic derivatives; perborate and percarbonate activating substances, i.e. tetracetylendiamine; bentonites and activated bentonites; carboxymethylcelluloses; amylolitic, lipolitic, proteolitic enzymes; polyvinylpirrolidones and derivatives thereof; optic whitening substances of stilbene and distiryl diphenyl derivatives; polyacrylates; dymethylpolyxyloxanes; coloring agents), by a weight rate of 0.1 to 30%.

Washing Base No. 3

This Example is disclosed for showing a possible mode for using the above mentioned active principles, to be added to washing and ironing aiding substances and comprising softening, stain removing, sizing and whitening substances, liquid formulated substances, gel, powder, tablets and single-dose packets.

The formulation according to the present invention comprises one or more of the following components:

- cationic bases (dialkylmethylammonium metasulphate; quaternized tert-amines, dialkyl-dymethylammonioum chloride; imidazoline), by a weight rate of 0.1 to 50%;
- amphoteric bases (alkylamidobetaine, alkylamidopropylbetaine, alkylamidosultaine), by a weight rate of 0.1 to 20%;
- anionic bases (sodium, tea, ammonium laurylether sulphate; sodium, tea, ammonium lauryl sulphate; sodium, tea, ammonium alkylbenzenesulphonate), by a weight rate of 0.1 to 50%;
- non ionic bases (alkyl C3-C22 linear or branched ethoxylated alcohols and with an ethoxylation and propoxylation degree of 2 to 30 moles; fat acid amides; alkylpolyglucosides; amine oxides), with a weight rate dose from 0.1 to 50%;
- active oxidating principles (sodium hypochlorite, hydrogen peroxide, mono and tetrahydrate sodium perborate, sodium percarbonate, sodium persulphate), by a weight rate of 0.1 to 99%;
- reducing active principles (sodium hydro-sulphite), by a weight rate of 0.1 to 99%;
- starches and modified starches by a weight rate from 0.1 to 30%;
- co-formulating and coactive substances: (phosphonates; ethylendiamine tetracetic acid derivatives; citric acid and sodium and potassium derivatives, ethyl and isopropyl alcohol; calcium, sodium and ammonium chlorides; amylolitic, lypolitic, proteolitic enzymes, polyvinylpirrolidones and derivatives thereof; optic whitening substances derived from distiril dyphenil; polymeric styrene/acryl dispersions; dymethyl polysiloxanes; isothiazolinones, benzoisothiazolinones; bronopol, N-formals; coloring substances), by a weight rate of 0.1 to 20%;
- natural essences or essence compositions; by a weight rate of 0.1 to 10%;

EXAMPLE NO. 1

An Exemplary Formulation of the Washing Base No. 1

In a case of a liquid cleansing substance for washing clothing articles, either by hand or in a washing machine, a preferential formulation provides to use two or more of the following components, by the weight rates thereinbelow indicated:

| | |
|---|---|
| Sodium laurylethersulphate | 8 |
| Alkylbenzenesulphonate TEA | 6 |
| TEO C12-15 Alcohol | 1.5 |
| Alkylamidosultaine | 1 |
| Hydroxyacetyl hydroxyethyl Ammonium chloride | 0.2 |
| Potassium soap | 3 |
| Ethylene Diamine Tetra Acetic Acid | 0.5 |
| Amylasis enzyme | 0.15 |
| Proteasis enzyme | 0.3 |
| Lipasis enzyme | 0.2 |
| Preserving agents | q.s. |
| Perfume | 0.3 |
| Cosmacol ELI | 0.8 |
| Isalchem 11 | 0.5 |
| Coloring or dyeing agents | q.s. |
| Water | q.s. |

EXAMPLE NO. 2

Exemplary Formulation of the Washing Basis No. 2

In the case of a powder cleansing agents for washing clothing articles either by hand or in a washing machine, a preferential formulation provides to use two or more of the following components in the indicated by weight rates:

| | |
|---|---|
| Sodium laurylsulphate | 10 |
| TEA alkylbenzesulphonate | 5 |
| TEO C12-15 alcohol | 7 |
| Alkylamidosultaine | 0.5 |
| Hydroxyacetyl hydroxyethyl Ammonium chloride | 0.2 |
| Potassium soap | 5 |
| Sodium percarbonate | 10 |
| Sodium carbonate | 15 |
| Sodium silicate | 3 |
| Ethylene Diamine Tetra Acetic Acid | 0.5 |
| Zeolite | 15 |
| Amilasis enzyme | 0.15 |
| Proteasis enzyme | 0.3 |
| Lipasis enzyme | 0.2 |
| Carboxymethylcellulose | 1.5 |
| Perfume | 0.3 |
| Cosmacol ELI | 1.5 |
| Isalchem 11 | 1 |
| Sodium sulphate | q.s. |

EXAMPLE NO. 3

Exemplary Formulation of the Washing Basis No. 3

A preferential formulation for a washing liquid aiding agents having a softening activity, provides to use the following components in the indicated by weight rates:

| | |
|---|---|
| Alkylamidosultaine | 1 |
| Dialkylesterammoniummetha-Sulphate | 10 |
| Ethylene Diamine Tetra Acetic | 0.5 |
| Preserving agents | q.s. |
| Perfume | 1.5 |
| Ethoxylated C12-18 10 OE alcohol | 1.5 |
| Silicone | 0.1 |
| Isopropyl alcohol | 1 |
| Cosmacol ELI | 0.8 |
| Isalchem 11 | 0.5 |
| Water | q.s |

It should be noted that a high number of experimental tests have been carried out for evaluating the formulations of the above disclosed Examples 1, 2 and 3.

The tests have been performed "in blind" on families including at least a member performing an intensive sports activity.

The above mentioned statistic samples have been asked to wash for at least five consecutive times the clothing articles worn in their sports activities, and upon having used them, and before washing, to close them in a plastics bag up to the following day.

After this period, the bag was opened and the smell and intensity thereof were evaluated.

An evaluation has been asked, rated by the numbers 0 to 5, 0 representing an odorless sample and 5 a strongly odorous sample, based on the following parameters:

1. the smell intensity after the first washing
2. the smell intensity after five washings The evaluation was unanimous for all the examined families, and the average values and related comparisons were as hereinbelow indicated:

| WASHING PRODUCT | SMELL INTENSITY At the first Washing (average value) | SMELL INTENSITY After five washings (average value) |
|---|---|---|
| Conventionally used Traditional product | 4 | 4 |
| Liquid product (4.1) | 2 | 1 |
| Powder product (4.2) | 3 | 2 |
| Softening agent (4.3) (*) | 2 | 1 |

(*) The softening agents have been used on the clothing articles washed by the conventional product It should be apparent that the deodorizing efficiency of the above three formulated products increases with the washing number, which effect is strictly related to the basic properties of the active principles, on the examined fabric materials.

Following washing operations increase the amounts of active principles deposited on the fabric fibers and, accordingly, increase the deodorizing properties thereof.

From the above disclosure it should be apparent that the invention fully achieves the intended aim and objects.

In particular, the invention provides a product comprising active principles, including alpha and beta hydroxy acid esters and aliphatic alcohols which can be added to cleansing agents and washing aiding agents for clothing articles, which product is very practical and functional and hinders any enzymatic activities of the skin microbic and bacteric microflora, which would be responsible of bad smells of clothing articles.

The invention, as disclosed, is susceptible to several modifications and variations, all of which will come within the scope of the invention.

Moreover, some components can be replaced by other chemically equivalent elements.

The invention claimed is:

1. A highly deodorizing washing product for washing a clothing article made of a fiber material, said washing product comprising a clothing article washing base to which are added highly deodorizing active principles, wherein said active principles comprise short chain alpha and beta hydroxy acid esters and zinc and/or magnesium derivatives of said short chain alpha and beta hydroxyl acid esters, $C_8$-$C_{10}$ fatty acid acylglutammate, octyl acid, glycerin, hydroxy diphenyl trichloro and hydroxy diphenyl chloro ethers, odorous molecule organic sequestering substances, active bentonites and zeolites, tocopherol and propylgallate, anti-perspiring ammonium salts, and one or more esters having a formula R—O—R', where R is a linear or branched alkyl radical having a $C_2$-$C_{34}$ chain and R' is an alpha or beta hydroxy acid radical, selected from glycol, lactic, citric, malic, tartaric, gluconic and mandelic acid esters, wherein said active principles are added to said washing base in an amount of 0.1 to 10% by weight of said washing base, and wherein said highly deodorizing washing product is such that, after washing, rinsing and drying said clothing article, a part of said highly deodorizing active principles remains bound to said fiber material of said clothing article thereby, as said clothing article is worn by a user releasing perspiration body enzymes, said enzymes react with said a part of said highly deodorizing active principles to decompose said alpha and beta hydroxy acid esters thereof to aliphatic odorless alpha hydroxy acids by preventing a generation of short chain fatty acids and. bad odors on said clothing article.

2. A washing product according to claim 1, wherein said washing base is selected from ethylendiamine tetracetic acid, coconut fatty alcohols such as ethoxylated fatty alcohols having a carbon number from 12 to 18, liquid or gel, or suspension powder formulated compositions containing one or more of:

- anionic. based selected from sodium, triethylamine, ammonium laurylether sulphate, zinc laurylether sulphate, sodium, triethylamine; ammonium lauryl sulphate; sodium, triethylamine, ammonium alkylbenzenesulphonate; sodium, triethylamine, ammonium, alkansulphonates; sodium, triethylamine, ammonium sulphonated alpha-olefins, in an amount from 0.1 to 50% by weight;
- non ionic bases selected from ethoxylated alcohols having a linear or branched $C_3$-$C_{22}$ alkyl chain and an ethoxylation and propoxylation degree from 2 to 30 moles; fatty acid amides; alkylpolyglucosides; amine oxides, in an amount from 0.1 to 50% by weight;
- amphoteric bases selected from alkylamido-betaine, alkylamidopropylbetaine, alkylamidosultaine, in an amount from 0.1 to 50% by weight;
- cationic bases, selected from dialkylmethyl ammonium methylsulphate and imidazoline, in an amount from 0.1 to 50% by weight;
- soaps selected from fatty acids salified by sodium, potassium, monoethylamine, triethylamine, in an amount from 0.1 to 50% by weight;
- coformulating and coactive agents selected from phosphonates; ethylendiamine tetracetic acid derivatives; citric acid and sodium and potassium derivatives, ethylene, propylene, dipropylene glycols; ethyl and isopropyl alcohol; activated bentonites; calcium and sodium chlorides; amylolytic, lipolytic, proteolytic enzymes; polyvinyl pyrrolidone and derivatives thereof; optic whitening agents derived from distiryldiphenyl; polymeric styrene/acrylic dispersions; polyacrylates; diethylpolysiloxanes; isothiazolinones, benzoisothiazolinones, bronopol, N-formals; coloring agents, in an amount from 0.1 to 20% by weight:
- natural essences or essence compositions, in an amount from 0.1 to 5% by weight.

3. A washing product according to claim 1, wherein said washing base comprises powder or tabletted formulated compositions, or a single-dose packet, containing one or more of:

- anionic bases selected from sodium, triethylamine, ammonium alkansulphonates; sodium, triethylamine, ammonium lauryl sulphate; sodium, triethylamine, ammonium alkylbenzene sulphonate, in an amount from 0.1 to 30% by weight;

non ionic bases selected from ethoxylated alcohols with a linear or branched $C_2$-$C_{22}$ alkyl chain and an ethoxylation and propoxylation degree from 2 to 20 moles; fatty acid amides; alkylpolyglucosides; amine oxides, in an amount from 0.1 to 30% by weight amphoteric bases selected from alkylamido-betaines, alkylamidopropylbetaines, alkylamido-sultaines, in an amount from 0.1 to 50% by weight;

soaps selected from sodium salified fat acids, in an amount from 0.1 to 30% by weight;

filling substances selected from powder and grained sodium sulphate, dense and light sodium carbonate, sodium silicate and disilicate, in an amount from 0.1 to 40% by weight;

coformulating and aiding substances selected from zeolites; mono and tetrahydrate sodium perborate, sodium percarbonate, sodium persulphate; phosphonates;

ethylendiamine tetracetic acid derivatives; citric acid and sodium derivatives; perborate and percarbonate activating substances, i.e. tetracetylendiamine; bentonites and activated bentonites; carboxymethylcellulose; amylolytic, lipolytic, proteolytic enzymes; polyvinylpyrrolidones and derivatives thereof; optic whitening substances of stilbene and distiryldiphenyl derivatives; polyacrylates; dimethylpolyxyloxanes; coloring agents, in an amount from 0.1 to 30% by weight.

4. A washing product according to claim 1, wherein said washing base further comprises washing and ironing aiding, softening or stain removing, sizing, or whitening substances, as liquid, gel, powder, or tablet formulations, or single-dose packets, containing one or more of:

cationic bases, in particular dialkyl-methylammonium methasulphate, dialkyldymethyl-ammonium chloride, and imidazoline, in an amount from 0.1 to 50% by weight;

amphoteric bases, in particular alkylamido-betaine, alkylamidopropylbetaine, alkylamidosultaine, in an amount from 0.1 to 50% by weight;

anionic bases, in particular sodium, triethylamine, ammonium laurylether sulphate; sodium, triethylamine, ammonium lauryl sulphate; sodium, triethylamine, ammonium alkylbenzene-sulphonate, in an amount from 0.1 to 50% by weight;

non ionic bases, in particular alkyl $C_3$ -$C_{22}$ linear or branched ethoxyated alcohols with an ethoxylation and propoxylation degree of 2 to 30 moles; fat acid amides; alkylpolyglucosides; amine oxides, in an amount from 0.1 to 50% by weight;

active oxidating principles, in particular sodium hypochlorite, hydrogen peroxide, mono and tetrahydrate sodium perborate, sodium percarbonate and sodium persulphate, in an amount from 0.1 to 99% by weight;

reducing active principles, in particular sodium hydro-sulphite, in an amount from 0.1 to 99% by weight;

starches and modified starches in an amount from 0.1 to 30% by weight;

co-formulating and coactive substances, in particular phosphonates; ethylendiamine tetracetic acid derivatives; citric acid and sodium and potassium derivatives, ethyl and isopropyl alcohol; calcium, sodium and ammonium chlorides; amylolytic, lipolytic, proteolytic enzymes, polyvinylpyrrolidones and derivatives thereof; optic whitening substances derived from distyryldiphenyl; polymeric styrene/acryl dispersions; dimethyl polysiloxanes; isothiazolinones, benzoisothiazolinones; bronopol, N-formals; coloring substances, in an amount from 0.1 to 20% by weight;

natural essences or essence compositions, in an amount from 0.1 to 10% by weight.

* * * * *